United States Patent [19]

Aikawa

[11] Patent Number: 4,966,240

[45] Date of Patent: Oct. 30, 1990

[54] COMBINATION BACKHOE VEHICLE AND BULLDOZER APPARATUS

[75] Inventor: Norihiro Aikawa, Sakai, Japan

[73] Assignee: Kubota, Ltd., Osaka, Japan

[21] Appl. No.: 274,572

[22] Filed: Nov. 23, 1988

[30] Foreign Application Priority Data

Dec. 16, 1987 [JP] Japan ..... 62-191841[U]
May 27, 1988 [JP] Japan ..... 63-70815[U]

[51] Int. Cl.[5] ..... E02F 3/77

[52] U.S. Cl. ..... 172/825; 172/822; 414/687

[58] Field of Search ..... 172/821, 825, 823, 701.2, 172/819, 820; 414/687

[56] References Cited

U.S. PATENT DOCUMENTS

| | | | |
|---|---|---|---|
| 2,137,829 | 11/1938 | Austin | 172/823 |
| 2,753,638 | 7/1956 | Mork | 172/825 |
| 3,083,480 | 4/1963 | Kirchler | 172/825 |
| 3,759,110 | 9/1973 | Davis | 172/819 |
| 3,926,263 | 12/1975 | Frisbee | 172/825 |
| 4,290,214 | 9/1981 | Stepe | 172/701.2 |
| 4,337,837 | 7/1982 | Nissen | 172/825 |
| 4,364,439 | 12/1982 | Asal | 172/821 |
| 4,552,503 | 11/1985 | Mouri | 414/687 |

FOREIGN PATENT DOCUMENTS

| | | | |
|---|---|---|---|
| 1634853 | 10/1970 | Fed. Rep. of Germany | 172/825 |
| 53-9445 | 4/1978 | Japan . | |

*Primary Examiner*—Richard J. Johnson
*Attorney, Agent, or Firm*—Edwin E. Greigg

[57] ABSTRACT

A bulldozer apparatus for a working vehicle comprising a vertically pivotable arm assembly, and a blade pivotable on a fore and aft axis extending along a center position of the vehicle. Two hydraulic cylinders are disposed at opposite sides of the fore and aft axis for causing pivotal movement of the blade such that the blade is pivotable in opposite directions with extensions of the hydraulic cylinders. Two engaging devices extend substantially longitudinally of the vehicle at opposite positions across the fore and aft axis and interconnect the blade and the arm assembly for relative pivotal movement.

3 Claims, 5 Drawing Sheets

COMBINATION BACKHOE VEHICLE AND BULLDOZER APPARATUS

BACKGROUND OF THE INVENTION

The present invention relates to a bulldozer apparatus for a working vehicle comprising a vertically pivotable arm assembly, a blade attached to the arm assembly to be pivotable about a fore and aft axis, and a hydraulic cylinder for causing pivotal movement of the blade.

In a conventional working vehicle having a bulldozer apparatus, the blade and the arm assembly are interconnected through a fore and aft axis and a linkage disposed at a right or left side of the fore and aft axis, and a single cylinder is provided for causing pivotal movement of the blade, as disclosed in Japanese Patent Publication No. 53-9445.

The known bulldozer apparatus, however, has the disadvantage of high cost with a great strength required of the fore and aft axis since a reaction force occurring when the vehicle moves backward or forward in an earth moving operation concentrates not only on the linkage but also on the position of attachment of the fore and aft axis having a complicated construction. A further drawback is noted when carrying out an excavating operation with the blade instead of outriggers placed in contact with the ground. The hydraulic pressure of the cylinder is locked adjacent the piston rod and at the bottom thereof at this time but, when the vehicle oscillates sideways under reaction forces of the excavation, the inside pressure at the piston rod end of the cylinder tends to increase over the inside pressure at the bottom thereof. Consequently, a relief tends to occur with a hydraulic circuit connected to the piston rod end of the cylinder, which may result in the danger of an inadvertent tilting of the vehicle.

SUMMARY OF THE INVENTION

The object of the present invention is to provide an improved bulldozer apparatus constructed at low cost and yet is capable of withstanding reaction forces resulting from an earth moving operation, and is effective to prevent sideways tilting of the vehicle when the blade is used in place of an outrigger.

In order to achieve this object, a bulldozer apparatus for a working vehicle according to the present invention comprises a vertically pivotable arm assembly, a blade pivotable on a fore and aft axis extending along a center position of the vehicle, a pair of hydraulic cylinders disposed at opposite sides of the fore and aft axis for causing pivotal movement of the blade such that the blade is pivotable in opposite directions with extensions of the hydraulic cylinders, and a pair of engaging means extending substantially longitudinally of the vehicle at opposite positions across the fore and aft axis and interconnecting the blade and the arm assembly for relative pivotal movement.

With the above construction, when the vehicle is moved backward or forward in an earth moving operation, the reaction force resulting from the operation is distributed to the fore and aft axis and the engaging means disposed at opposite lateral sides thereof. Even when such a reaction force is offset either rightward or leftward of the blade, the reaction force is received by either one of the engaging means instead of concentrating on the fore and aft axis as in the prior art.

When carrying out an excavating operation with the blade placed in contact with the ground to act as an outrigger, the reaction force is shared by the pair of right and left hydraulic cylinders. If the vehicle oscillates sideways, the reaction force acting on the piston rod end of one of the cylinders is received also by the bottom end of the other cylinder at the same time. Consequently, an increase in the internal pressure at the piston rod end of one of the cylinders is checked by the bottom end of the other cylinder, thereby preventing a relief from occurring with the hydraulic circuits associated with the two cylinders, respectively.

The present invention thus realizes an advantage of economy with increase durability against earth moving operations, which is achieved by providing inexpensive engaging means at laterally opposite positions without increasing the strength of the attaching position of the fore and aft axis having a complicated construction. Furthermore, the vehicle has little chance of tilting sideways when the blade is used in place of an outrigger, thereby allowing an excavating operation to be carried out in a stable manner and with increased safety.

In a preferred embodiment of the invention, the engaging means are constructed to allow the blade to pivot about the fore and aft axis within a predetermined range and to move longitudinally of the vehicle toward and away from the arm assembly within a predetermined range.

According to this construction, the engaging means allow rolling of the blade relative to the arm assembly so that the blade is adjustable through a control mechanism. Further, the engaging means may have suitable play so that, when a front face or a rear face of the blade is used in a bulldozing operation, the engaging means are operable to receive or pull the blade, thereby safeguarding the control mechanism against the reaction force.

The blade may be supported by the engaging means in addition to the pivotal connection of the blade. This construction allows the pivotal connection to have a relatively light and frail structure providing support of less strength when the rear face of the blade is used than when the front face thereof is used in a bulldozing operation. The blade support provided by the engaging means against the reaction force acting in the fore and aft direction of the vehicle is effective to protect the pivotal connection of the blade from deformation and damage which are likely to occur where the blade support is provided by the pivotal connection alone.

Further, the engaging means allow the control mechanism to have a relatively light and frail structure with a strength sufficient only for supporting the blade against vertically acting reaction forces, and the pivotal connection of the blade to have a relatively light and frail structure with a strength sufficient only for permitting pivotal movement of the blade. The bulldozer apparatus according to the present invention has advantages of light weight and economy with respect to both the control mechanism and the pivotal connection.

Other features and advantages of the present invention will be apparent from the following description.

BRIEF DESCRIPTION OF THE DRAWINGS

The drawings illustrate a bulldozer apparatus for use with a working vehicle according to the present invention, in which.

DESCRIPTION OF THE PREFERRED EMBODIMENTS

The present invention will be described hereinafter as applied to a backhoe which is one example of working vehicle.

Figure 1:
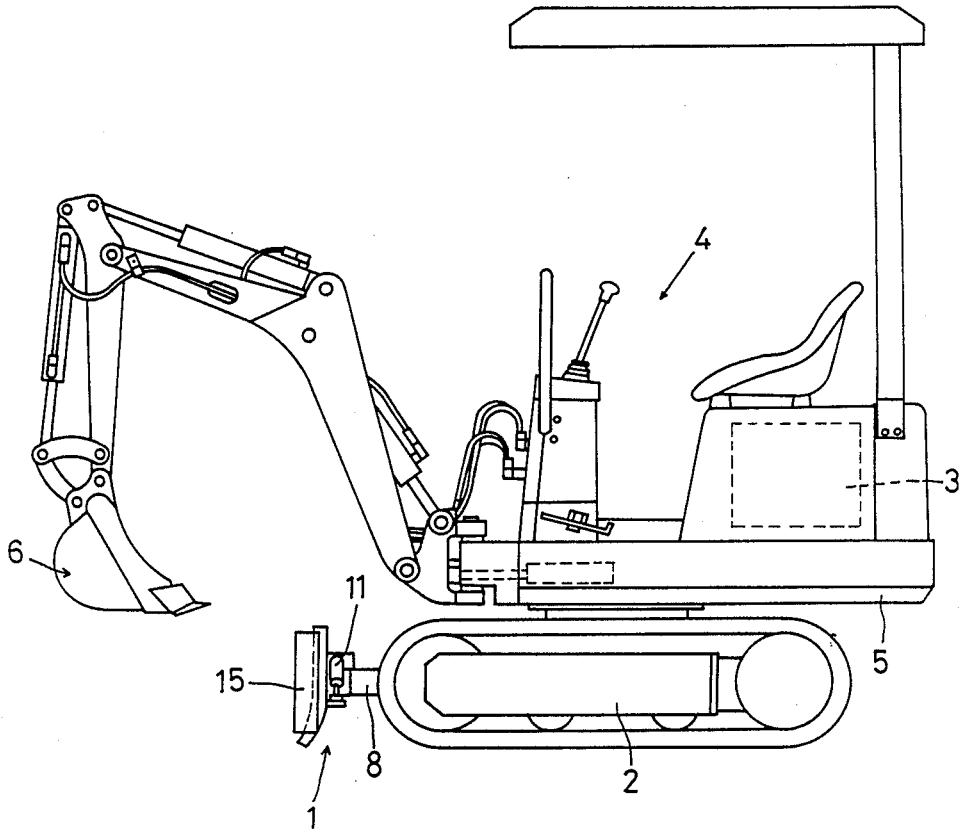
FIG. 1 is a side elevation of a backhoe equipped with the bulldozer apparatus.

Referring to FIG. 1, The backhoe comprises a bulldozer apparatus 1 attached to a crawler running device 2 supporting a swivel deck 5. The swivel deck 5 carries a motor section 3, a driver's section 4, and a backhoe implement 6.

Figure 2:
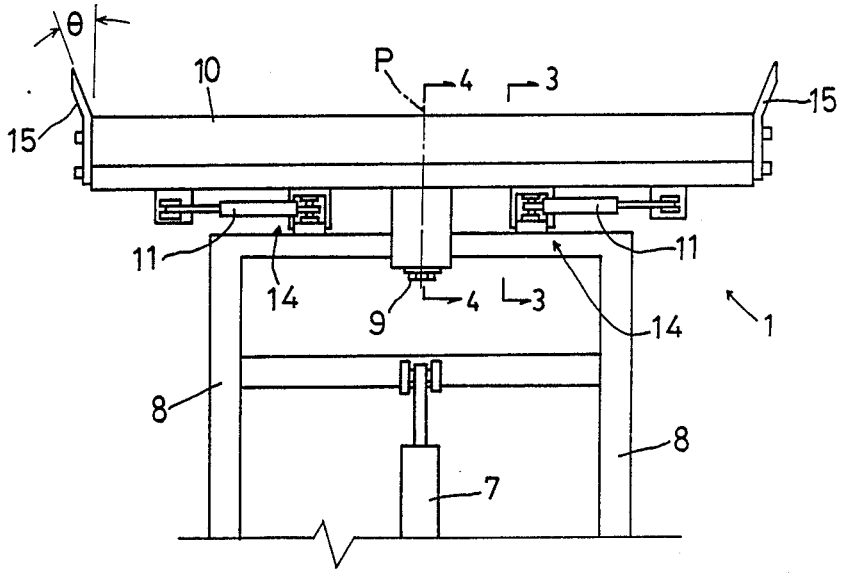
FIG. 2 is a plan view of the bulldozer apparatus.
Figure 4:
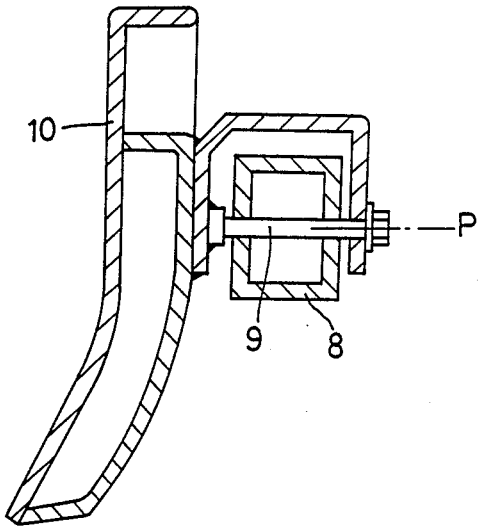
FIG. 4 is a section taken on line 4—4 of FIG. 2.

Referring to FIGS. 2 and 4, the bulldozer apparatus 1 includes an arm assembly 8 vertically pivotable by a lift cylinder 7 relative to the running device 2. The arm assembly 8 carries a blade 10 attached thereto through a pivot pin 9 to be pivotable on an axis P extending longitudinally of the vehicle. The blade 10 is pivotable relative to the arm assembly 8 under control of a pair of hydraulic cylinders 11 mounted at opposite sides of the pivot pin 9 transversely of the vehicle and extending between the blade 10 and arm assembly 8. These hydraulic cylinders 11 have main cylinder bodies connected to upper positions of the arm assembly 8 and piston rods connected to lower positions of the blade 10, respectively, such that the blade 10 is pivotable in opposite directions with extensions of the hydraulic cylinders 11. The blade 10 is thus raised and lowered by the lift cylinder 7 and rolling-controlled by the hydraulic cylinders 11.

Figure 3:
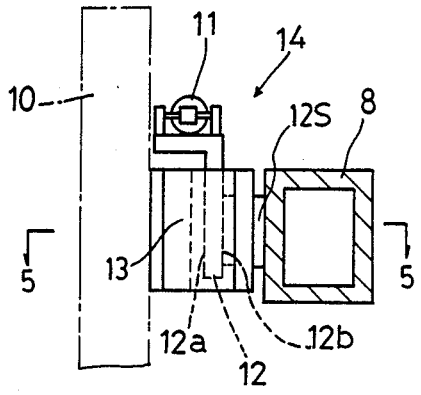
FIG. 3 is a section taken on line 3—3 of FIG. 25.
Figure 5:
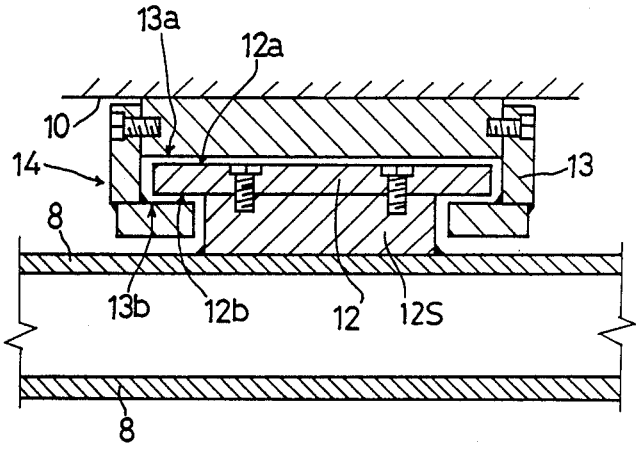
FIG. 5 is a section taken on line 5—5 of FIG. 3.

A device for causing engagement between the blade 10 and arm assembly 8 will be described next with reference to FIGS. 3 and 5.

This device, which is one of engaging devices 14 in the drawings, includes an arm-side engaging member 12 bolted to the arm assembly 8 through a spacer 12*s* at each of the opposite lateral sides of the pivot pin 9 to act also as an attaching bracket for one of the hydraulic cylinders 11, and a blade-side engaging member 13 attached to a rear face of the blade 10 at each of the opposite sides of the pivot pin 9 in opposed relationship with the arm-side engaging member 12. This engaging device 14 is provided to maintain the blade 10 within a predetermined range of movement longitudinally of the vehicle relative to the arm assembly 8, thereby to prevent a reaction force acting on the blade 10 longitudinally of the vehicle from being imparted to the hydraulic cylinders 11 and pivot pin 9. The engaging device 14 operates as follows:

The blade-side engaging member 13 and arm-side engaging member 12 define clearances therebetween transversely of the vehicle for providing some play, whereby the blade-side engaging member 13 is capable of pivoting upward and downward about the axis P relative to the arm-side engaging member 12, and hence allows the blade 10 to pivot about the axis P.

When the front face of the blade 10 is used in an earth moving operation, a backward reaction force acts on the blade 10. Then, owing to the play between the blade 10 and arm assembly 8, a rearwardly facing working surface 13*a* of the blade-side engaging member 13 contacts a forwardly facing working surface 12*a* of the arm-side engaging member 12. The blade 10 is thus backed by the arm-side engaging member 12.

When the rear face of the blade 10 is used, a forward reaction force acts on the blade 10. Then, forwardly facing working surfaces 13*b* of the blade-side engaging member 13 contact rearwardly facing working surfaces 12*b* of the arm-side engaging member 12. The blade 10 is thus held against forward movement.

As shown in FIG. 2, the blade 10 carries side cutters 15 at opposite lateral ends thereof for facility in breaking or leveling banking and normal planes. The side cutters 15 are bolted to be detachable and have cutting edges projecting laterally outwardly at an angle of inclination $\theta$.

Figure 6:
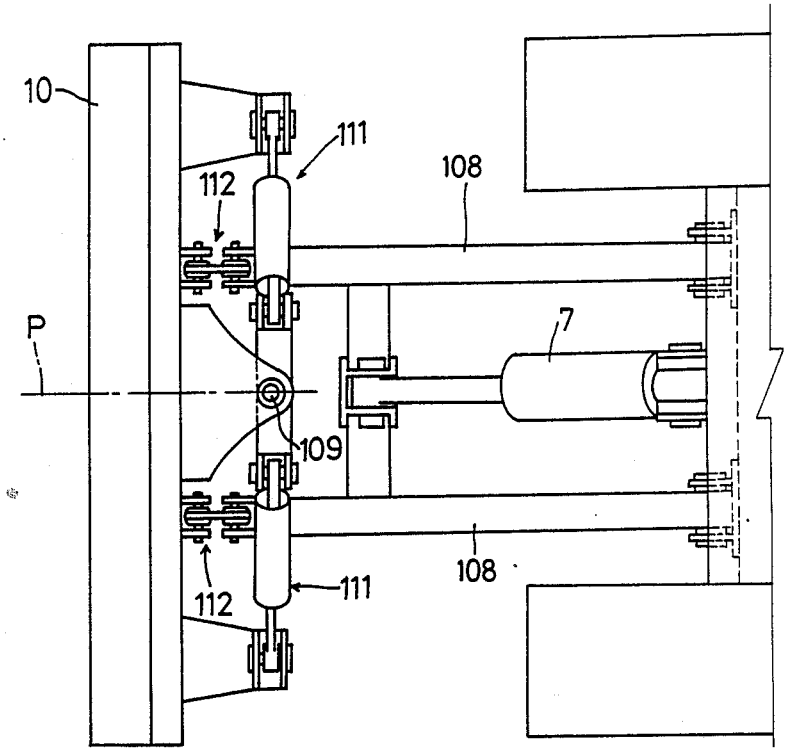
FIG. 6 is a plan view of a bulldozer apparatus according to another embodiment of the invention.
Figure 7:
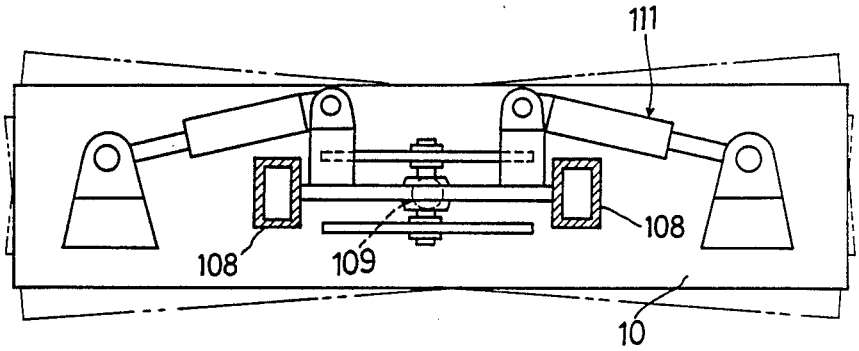
FIG. 7 is a rear view of the bulldozer apparatus shown in FIG. 6.
Figure 8:
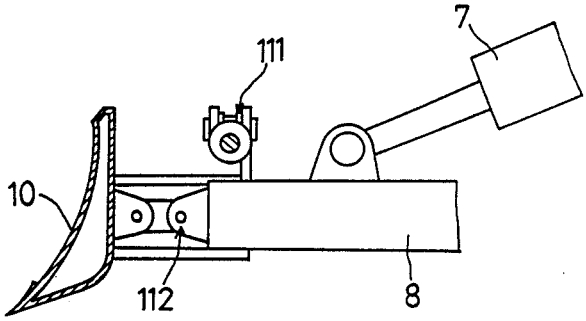
FIG. 8 is a side view of the bulldozer apparatus shown in FIG. 6.

FIGS. 6 through 8 show another embodiment in which the blade 10 is attached to the arm assembly 108 through a ball bearing 109 to be pivotable about the fore and aft axis P. The engaging devices here comprise linkages 112 for allowing relative pivotal movement between the blade 10 and arm assembly 108. The linkages 112 are provided at opposite sides of the fore and aft axis P as in the foregoing embodiment, and extend longitudinally of the vehicle. Each linkage 112 is connected to the blade 10 and arm assembly 108 through ball bearings. Hydraulic cylinders 111 in this embodiment correspond to the hydraulic cylinders 11 in the foregoing embodiment.

Figure 9:
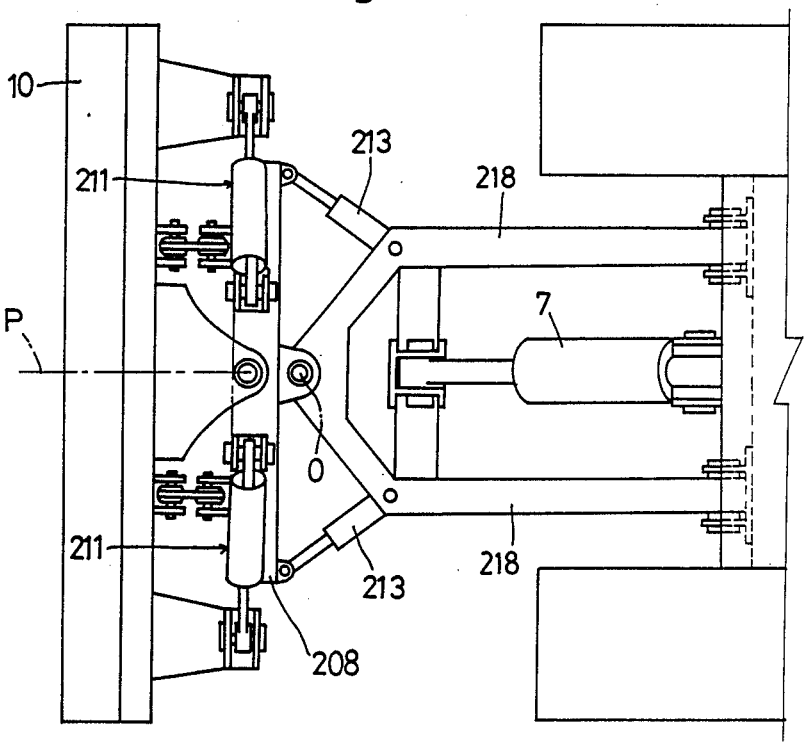
FIG. 9 is a plan view of a bulldozer apparatus according to a further embodiment of the invention.

FIG. 9 shows a further embodiment in which the blade 10 is attached to a bracket 208 to be pivotable about the fore and aft axis P, and the bracket 208 is attached to a forward end of the arm assembly 218 to be pivotable fore and aft about a vertical axis 0. A pair of right and left angling cylinders 213 extend between the arm assembly 218 and bracket 208 for causing the fore and aft pivotal movement of the blade 10. This embodiment includes hydraulic cylinders 211 for causing vertical pivotal movement of the blade 10.

Each hydraulic cylinder 11 may be attached conversely of the described manner, i.e. with the cylinder body connected to the blade 10 and the piston rod to the arm assembly 218.

The present invention may employ other pivoting control means than the hydraulic cylinders 11, such as manually operable screw devices.

What is claimed is:

1. A combination backhoe and bulldozer apparatus for a working vehicle comprising;

a vehicle body (2), a swivel deck (5) pivotably mounted on said vehicle body (2), a backhoe implement operatively attached to said swivel body, a bulldozer apparatus mounted on said vehicle body (2), said bulldozer apparatus including a vertically pivotable arm assembly (8), a blade (10) pivotable on a fore and aft axis (P) and supported on said arm assembly (8) along a center line of the vehicle body, a pair of hydraulic cylinders (11, 11) disposed at opposite sides of said fore and aft axis (P) and connected to said blade and to said arm assembly for causing pivotal movement of said blade (10) such that said blade (10) is pivotable in opposite directions with extensions of said hydraulic cylinders (11, 11), said cylinders (11, 11) have main cylinder bodies thereof connected to upper positions of said arm assembly (8) and piston rods thereof connected to lower positions of said blade (10) and said cylinders extend parallel with said blade, a pair of engaging support means (14, 14) extending substantially longitudinally of the vehicle at opposite positions across said fore and aft axis (P), and interconnecting said blade (10) and said arm assembly (8) for relative pivotal movement, said blade (10) being pivotable about said fore and aft axis (P) by means of a pivot pin (9) provided on said arm assembly (8), said engaging support means (14) includes a pair of blade-side engaging members (13) connected to said blade (10) and an arm assembly-side engaging member (12) connected to said arm assembly (8), said arm assembly-side engaging member (12) having an inverse letter L-shaped configuration with a horizontal portion thereof projecting upwardly and forwardly, said main cylinder bodies being connected to upper positions of said horizontal portion, and with perpendicular positions having forwardly and rearwardly facing working surfaces (**12*a*), (12*b*) which are contactable with forwardly and rearwardly facing working surfaces (13*a*), (13*b*) of said blade-side engaging member (13), respectively, said pair of engaging supports means (14, 14) being constructed to permit said blade (10) to pivot about said fore and aft axis (P) within a predetermined range and to move longitudinally of said vehicle body toward and away from said arm assembly (8**) within a predetermined range, and said bulldozer apparatus is operable to function as an outrigger during an earth excavation operation by said backhoe.

2. A combination backhoe and bulldozer apparatus as claimed in claim 1, wherein said blade (10) carries side cutters (15) at opposite right and left ends thereof.

3. A combination backhoe and bulldozer apparatus as claimed in claim 2, wherein each of said side cutters (15) have a cutting edge extending laterally outwardly at an inclination angle $\theta$.

* * * * *